United States Patent [19]

Anderson et al.

[11] 4,072,121

[45] Feb. 7, 1978

[54] YACHT MAST

[75] Inventors: Warren Malcolm Anderson, Beacon Hill; Clifford John Shaffran, Paddington, both of Australia

[73] Assignee: Clifford Industries PTY., Ltd., Sydney, Australia

[21] Appl. No.: 725,024

[22] Filed: Sept. 20, 1976

[30] Foreign Application Priority Data

Sept. 25, 1975 Australia ..... 3334/75

[51] Int. Cl.[2] ..... B63B 27/14; G63B 35/00

[52] U.S. Cl. ..... 114/90; 138/158; 138/165

[58] Field of Search ..... 114/39, 89–98, 114/102, 112, 113, 114, 115; 52/720, 730, 731, 461, 464, 468; 138/157, 158, 156, 162, 163, 164, 165, 167; 29/155 R, 155 C, 433, 463; 285/417, 419, 421

[56] References Cited

U.S. PATENT DOCUMENTS

| | | | |
|---|---|---|---|
| 121,318 | 11/1871 | Bender | 138/158 |
| 549,905 | 11/1895 | Durham | 52/468 |
| 2,245,102 | 6/1941 | Field | 138/165 |
| 2,627,949 | 2/1953 | Willson | 52/461 |
| 2,714,424 | 8/1955 | Atkinson | 138/158 |

FOREIGN PATENT DOCUMENTS

| | | | |
|---|---|---|---|
| 1,444,722 | 11/1966 | France | 114/90 |
| 594,092 | 11/1947 | United Kingdom | 114/89 |
| 1,349,160 | 3/1974 | United Kingdom | 114/90 |

*Primary Examiner*—Trygve M. Blix
*Assistant Examiner*—D. W. Keen
*Attorney, Agent, or Firm*—J. Harold Nissen

[57] ABSTRACT

An elongate mast section that when joined to at least one further section along the longitudinal edges thereof forms a mast. Each longitudinal edge has a U-shaped portion including a protruding flange which is joined to the corresponding flange of the adjacent section by means of a joining strip. A wedge is driven between the bases of the flanges to force the flanges into firm frictional engagement with the joining strips to complete the basic mast.

10 Claims, 11 Drawing Figures

YACHT MAST

This invention relates to an improved mast section and a method of joining longitudinal metal mast sections to form a mast, particularly a yacht mast.

Whilst this invention will be described in relation to yacht means it will be obvious to any person skilled in the art that it may be used for joining any two pieces of substantially rigid shell material to form a tubular structure.

Construction of known types of metallic yacht mast usually takes any one of three forms.

In one form the mast may be made from an extruded tube of say aluminium, steel, stainless steel, titanium and other alloys. The extruded tube may additionally include a sail track on one side thereof as part of the extrusion. However, these types of masts are not very satisfactory for masts over about 30 feet in length as they are very difficult to anodise, transport and store.

Another method of constructing masts is to extrude half shell sections, add the appropriate fittings to what is to become the internal section of the mast, and weld or rivet the half shell sections together. The joining of the shell sections by welding is a very difficult process as the sections must be maintained in an exact mating and aligned relationship during the welding, which requires very costly equipment and skilful handling. Rivetting of the mast sections together is a very labour intensive, costly and tedious process.

A third method involves extruding two half shell sections to be joined together by a rivetted tongue and groove system. The tongue and complimentary groove being formed on the shell edge at what is to be the side of the mast. This has the disadvantage of a lack of structural strength over the prior methods.

The construction of mast sections has undergone such trial and error in the past. The key factors for the design of mast sections are metal alloy, mast diameter, wall thickness, shell configuration and weight.

These factors combine to determine the stiffness, which may be measured by the moment of inertia of the section, and strength of the mast.

It is an object of this invention to provide a mast section suitable for fabrication from at least two sections.

In its broadest form the invention provides an elongate mast section comprising an elongate shell having a curved transverse section and along each longitudinal side edge an inwardly turned web which joins a flange to said shell, said flange being inwardly turned towards said shell with respect to said web, such that the transverse cross-section of the flange, web and the adjacent portion of the shell form a substantially U-shaped portion, and the outer surface of the base of said U-shaped portion being bevelled such that when a further mast section is brought into opposing side-by-side relationship with said first section, the corresponding bevelled surface of said second section forms a substantially V-shaped gap with the bevelled surface of said first section such that the apex of said V-shaped gap is innermost.

The invention provides a number of advantages over the prior art.

A complete mast may be made by any person without the need for highly skilled labour.

The half shell section system of making masts allows the shells can be made in convenient lengths, say 30 feet, which easily fit into most anodising tanks and are easily transportable.

Where a mast longer than say 30 feet is required, the head of one shell section is abutted with the base of a further shell section and the two are joined together by fixing them to a common sleeve.

Once the desired length of mast has been formed by sleeving (if necessary), the shell sections are joined together by sliding a joining strip over the adjacent flanges, and driving a wedge tightly into the V-gap between the bases of the U-shaped portions to tightly engage the flanges with the joining strip.

The joining strip and wedge system of joining the two shell sections substantially reduces the labour and capital intensive processes of the aforementioned prior art. By using at least half shell sections, all the fittings may be put onto the half shells before they are joined thus facilitating ease of handling and assembly.

The joining system whilst adding weight to the mast section simultaneously provides an internal structural section within the mast which stiffens the mast. Thus larger yachts can use masts having a smaller cross-section, for a given strength requirement, which have less windage. The joining system is also inherently stronger than the rivet and welding methods.

The invention will now be described by way of example only with reference to the accompanying drawings, wherein.

Figure 1:
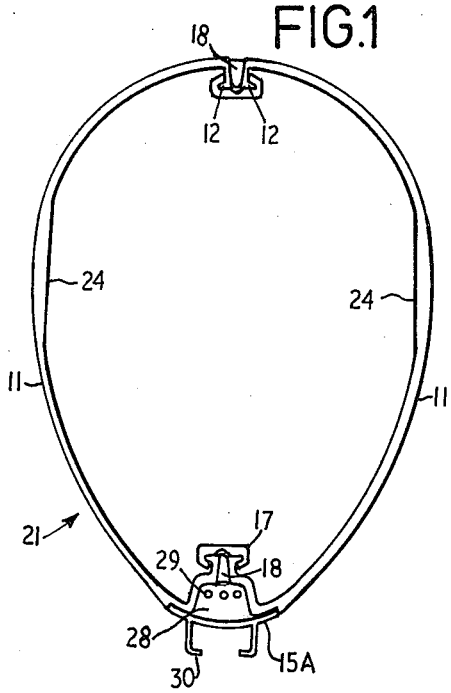
FIG. 1 is a transverse cross-section of a mast in accordance with the present invention.

In FIG. 1 a transverse cross-section of a mast 21 constructed in accordance with the preferred form of this invention is shown.

The mast 21 is formed from two half shell sections, 11, 11 which are joined along their longitudinal side edges which are arranged for the purpose of this embodiment at the leading and trailing "edges" of the mast 21. The trailing edge being the one incorporating the sail track 30. The leading edge being opposite the trailing edge.

Alternately the longitudinal edges of the shell sections could be formed so that they joined at either side of the mast 21. Further still the mast may be formed from more than two shell sections by having joining portions at the intersection of each shell piece.

Figure 2:
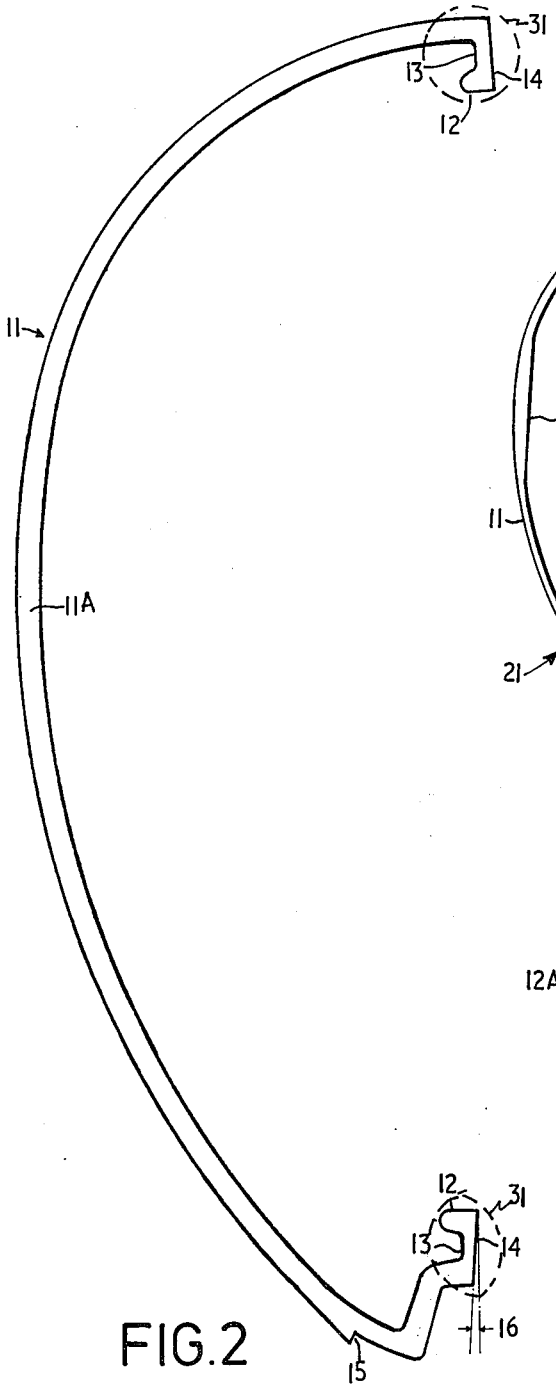
FIG. 2 is a transverse cross-section of a half shell extruded section in accordance with the invention.

However, the advantage of the embodiment shown in FIGS. 1 and 2 is that only one half shell section need be formed as it is used for both sides of the mast. This is particularly shown in FIG. 2 wherein it can be seen how a half shell mast section 11 of a mast may be extruded to form one side of the mast.

The shell section 11 of FIG. 2 comprises a curved body section 11A which has at either longitudinal edge an inturned web 13 joining an inturned flange 12 to the body of the shell section 11A.

Figure 8:
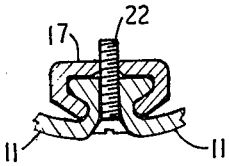
FIG. 8 is a partial view of the trailing edge of the mast showing a fastener in exploded position.

The combination of the flange 12, web 13 and edge portion of the shell 11A forms a portion 31 of generally U-shaped transverse cross-section at either longitudinal edge of the shell 11. The base 14 of the U-shaped section 31 is bevelled 16 so that when the other half shell section 11 of the mast is abutted to the first half shell section 11 (as shown in FIGS. 1 and 8) the corresponding bevels 16 forms a V-shaped gap. The V-shaped gap has its apex or imaginary apex innermost.

Figure 3:
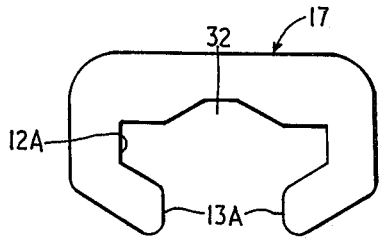
FIG. 3 is a transverse cross-section of a joining strip used to join the metal shell sections of FIG. 2.
Figure 4:
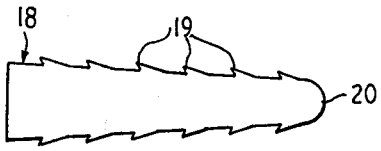
FIG. 4 is an end elevational view of the elongated wedge used in the joining operation.
Figure 9:
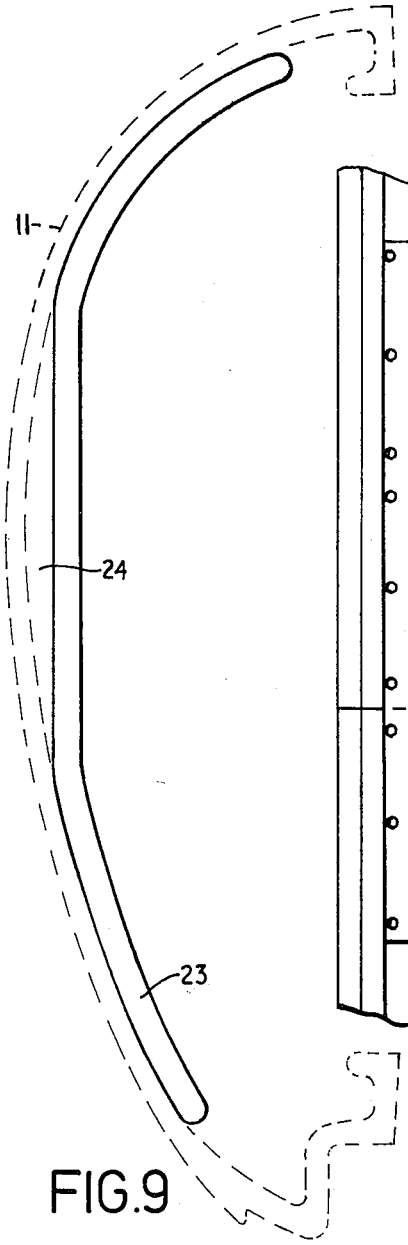
FIG. 9 is an end elevational view of a joining sleeve.
Figure 4A:
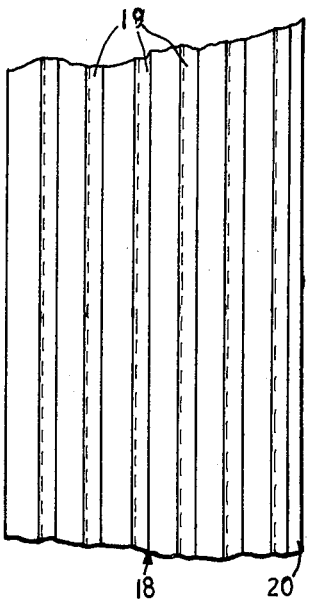
FIG. 4A is a plan view of the wedge of FIG. 4.
Figure 5:
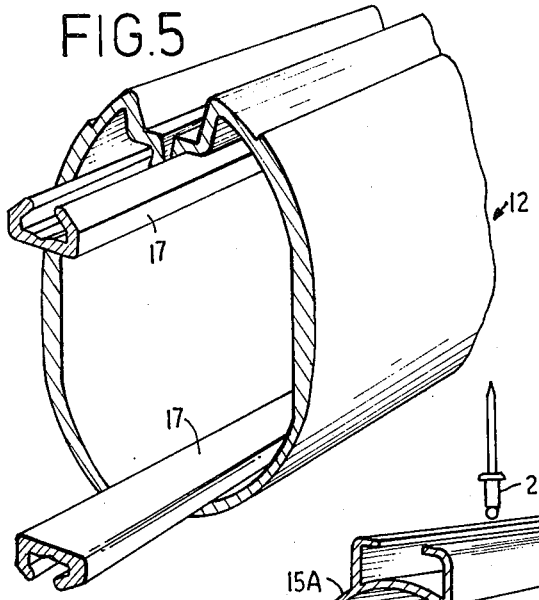
FIG. 5 is a perspective view from and end of a partly joined mast.
Figure 5:
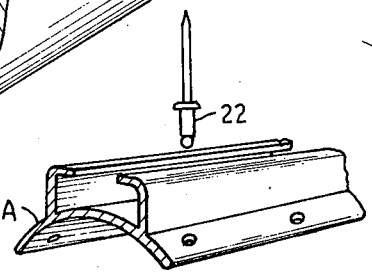
Figure 6:
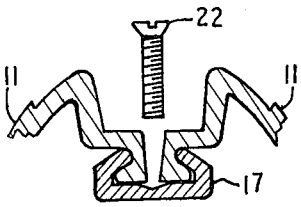
FIG. 6 is an end view similar to FIG. 5 with the wedges and sailtrack shown in an exploded formation.

Shown in FIG. 3 is a transverse cross-section of an elongate, joining strip 17. The joining strip 17 has a suitable cross-section to slide along the flanges 12 and webs 14 of the shells 11 which have been brought together as shown in FIGS. 1, 5, 6, 7 and 8. Thus the two shells 11 are joined together by the joining strip 17 as shown in FIGS. 5 and 6 ready to receive a wedge 18 (FIGS. 4 and 4A) into the V-shaped gap formed by the base surfaces 14.

The wedge 18 is driven into the V-shaped gap, with its narrowest end first, with as much force as possible to force the bases 14 of aligned shells 11, apart. The flange receiving portions 12A and web receiving portions 13A of the joining strip 17 are thus firmly locked to their respective flanges 12 and webs 13 of the shells 11. The joining strip 17 may have a gap 32 to accommodate the heading edge of the wedge (which may protrude beyond the base 14).

The wedge 18 may have a series of longitudinal ridges 19 which assist in maintaining the wedge 18 in its friction fit in the V gap. In particular, if the ridges 19 have a sharp spur type extremity, as shown, they have an extremely high resistance to forces tending to displace the wedge. Other types of friction surfaces may be used, although a smooth surface is sufficient. Also the base 14 of the V-gap may comprise a friction surface by way of ridges or serrations complementary to those of the wedge 18, or other friction means. However by providing a greater number of serrations per inch than the ridges 19 of the wedge 18, allows for a greater wedging portions.

The wedge 18 may be made from 6063 aluminium alloy having a T1 temper, whilst the mast shell sections 11 and joining strip 17 may be made from a harder aluminium alloy such as 6351, having a T5 temper.

By making the wedge 18 from a softer alloy, the spurs on the extremities of the ridges 19 will deform as the wedge is driven into the V gaps, and on deforming they will conform the outer surface of the wedge 17 substantially to the serated surface of the base 14. This results in a mechanical interconnection which has a high shear strength with respect to the loads to be experienced.

After the wedge 18 has been inserted the mast is ready for use. However, the basic mast shown in the drawings is completed by the addition of the sail track 30 to be rivetted 22 through the track mounting flanges 15A onto the track receiving portion 15 at the trailing edge of the mast 12.

The track 30 in combination with the recessed trailing edge of the mast 12 provides a channel 28 useful for carrying electrical wiring 29 to the various points of the mast 12. The box section of the channel also increases the stiffness of the mast 12.

If the wedge 18 is correctly driven into the V groove the mast 12 is a rigid structure requiring no further means to hold it together.

However as an additional measure to ensure the mast configuration will remain intact, fasteners such as self tapping screws or bolts 22 (FIGS. 7 and 8) may be used to interconnect the joining strip 17 with the shell 11.

Figure 10:
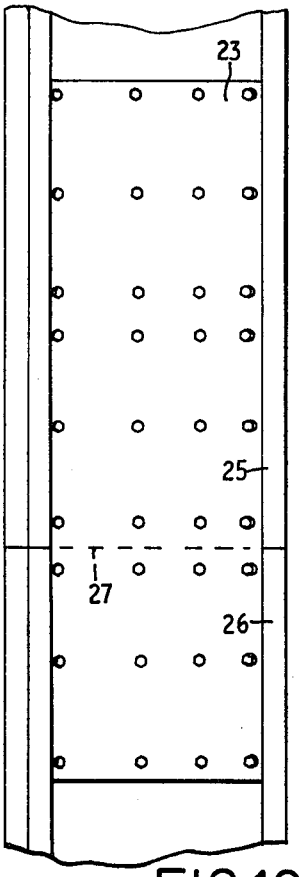
FIG. 10 is a side view of a pair of sleeved partial mast functions.
Figure 7:
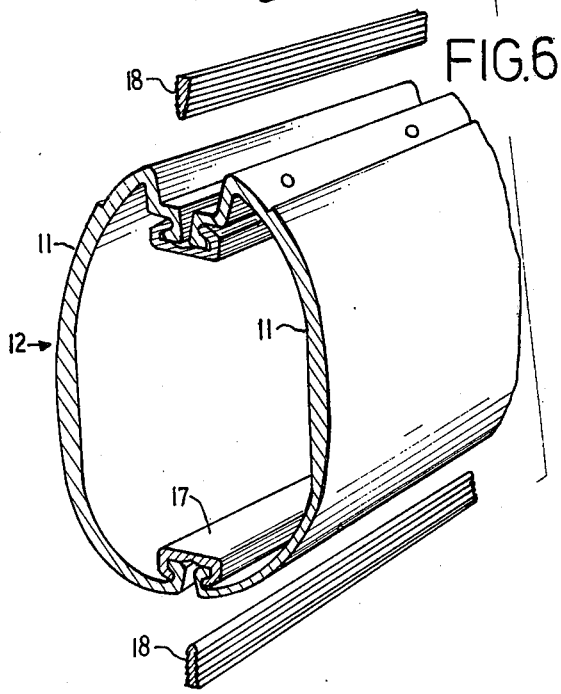
FIG. 7 is a partial view of the leading edge of the mast with a fastener inserted therein.

The self tapping screws or bolts 22 are inserted through holes drilled at either end of the wedge portions 18 (FIG. 4) and secure the shells 11 to the joining strip 17 (FIG. 8). Alternately, holes may be drilled through the wedge 18 and joining strip 17 so that the fasteners 22 actually pass through the wedge 18 and joining strips 17 to hold the wedge 18 firmly in position (FIG. 7). The fasteners are however only an additional safety measure, and if the mast has been assembled correctly, they should not be required.

Where the length of the mast 12 is to be greater than the length of the standard production shell section 11 the base of one mast shell section 26 is abutted 27 with the top of an additional shell 26 as shown in FIG. 10. A sleeving member 23 conforming to the shape of the major part 11A of the shell body 11 is mechanically attached to both shells by mechanical means such as epoxy glue and rivets.

A similar procedure is carried out on the mast shells for the other half of the mast. The shell sections 11 are then joined together by means of the joining strip and the wedge as previously described.

As with known masts each shell 11 may have thickened walls 24 at desired regions to provide extra strength of the finished mast.

Before joining the two half shell sections 11 together the required fittings, such as spreaders and internal rigging, should be attached to the sections 11.

Preferably the wedge 18 is not anodised. Thus after it has been inserted into the V-gap and the mast exposed to the weather the aluminium at the interface between the wedge 18 and surface 14 oxidizes. The oxide layer further adds to the frictional engagement of the wedge 18 with the surfaces 14 of the V-gap.

What we claim is:

1. An elongate mast section adapted for joining to a second similar mast section to form a yacht mast without use of rivets or weldments, each said mast section comprising:

an elongate shell having a curved cross-section and opposite ends, each said end having along each longitudinal side an integral inwardly turned web, which joins a flange to said shell;

each said flange being inwardly turned towards said shell with respect to said web such that the transverse cross-section of the flange, web and the adjacent portion of the side form a substantially U-shaped portion; and, the outer surface of the base of said U-shaped portion being bevelled such that when said second similar mast section with a complementary bevel is brought into opposing side-by-side relationship with said first section, each of the corresponding bevelled surfaces of said second section forms a substantially V-shaped gap with the corresponding bevelled surfaces of said first section such that the apex of each of said V-shaped gaps is innermost.

2. The mast section of claim 1 wherein said base has a surface comprised of a series of longitudinal serrations.

3. The mast section of claim 1 wherein said section is a longitudinal half shell section of a mast.

4. A mast comprising a pair of the mast sections of claim 3 each longitudinal side of the first section is joined to the corresponding side of the second section of said pair, by means of a joining strip interlinking the adjacent flanges and a wedge member driven between the adjacent bases of said U shaped portions in tight frictional engagement forcing said bases apart to force the webs and flanges into tight frictional engagement with each said respective joining strip.

5. The mast of claim 4 wherein said wedge is an elongate member having at least one longitudinal ridge on each base contact side.

6. The mast of claim 4 including:

fasteners interconnecting said joining strip with the outer edge of said wedge, and said fasteners additionally holding said wedge in place.

7. A mast comprising a plurality of the mast section defined in claim 1, including a joining strip and a wedge, wherein each longitudinal side of each section is interconnected to the adjacent longitudinal side of the adjacent section by means of said joining strip and said wedge;

said joining strip having a substantially U-shaped cross-section including a base and a pair of oppositely disposed leg portions including a flange receiving portion and a web receiving portion wherein said joining strip interlinks the two adjacent flanges of each adjacent section together with each said flanges being received within one of the said flange receiving portion and said webs being received within said web receiving portion, and said wedge is disposed in a tight frictional engagement between, and with, the adjacent bases of said U-shaped portions so as to force said bases apart and force said webs and said flanges into tight frictional engagement with each said respective joining strip.

8. The mast of claim 7 wherein said wedge is an elongate member having at least one longitudinal ridge on each base contact side.

9. The mast of claim 8 wherein said wedge is formed of a softer aluminium alloy than said mast sections.

10. The mast of claim 8, including:

fasteners interconnecting said joining strip with each said mast section.

* * * * *